US010717013B2

(12) United States Patent
Cummins et al.

(10) Patent No.: US 10,717,013 B2
(45) Date of Patent: Jul. 21, 2020

(54) AMUSEMENT RIDE

(71) Applicant: SKYSURFER INTERNATIONAL LIMITED, Wellington (NZ)

(72) Inventors: Robert Cummins, Wellington (NZ); Harry Robert John Cummins, Lower Hutt (NZ)

(73) Assignee: SKYSURFER INTERNATIONAL LIMITED, Wellington (NZ)

( * ) Notice: Subject to any disclaimer, the term of this patent is extended or adjusted under 35 U.S.C. 154(b) by 0 days.

(21) Appl. No.: 16/467,369

(22) PCT Filed: Dec. 8, 2017

(86) PCT No.: PCT/NZ2017/050158
§ 371 (c)(1),
(2) Date: Jun. 6, 2019

(87) PCT Pub. No.: WO2018/111121
PCT Pub. Date: Jun. 21, 2018

(65) Prior Publication Data

US 2020/0094153 A1 Mar. 26, 2020

(30) Foreign Application Priority Data

Dec. 14, 2016 (NZ) ..... 727536

(51) Int. Cl.
*A63G 9/16* (2006.01)
*A63G 31/00* (2006.01)

(52) U.S. Cl.
CPC ..... *A63G 9/16* (2013.01)

(58) Field of Classification Search
CPC ... A63G 9/00; A63G 9/02; A63G 9/12; A63G 9/16; A63G 31/00; A63G 31/16
(Continued)

(56) References Cited

U.S. PATENT DOCUMENTS 5,267,906 A 12/1993 Kitchen et al.
5,527,223 A 6/1996 Kitchen et al.
(Continued)

FOREIGN PATENT DOCUMENTS

AU 75360/96 6/1997
AU 744301 B2 6/2002

OTHER PUBLICATIONS

International Searching Authority, International Search Report and Written Opinion for International Application No. PCT/NZ2017/050158, dated Apr. 3, 2018, 7 pages, Australian Patent Office, Australia.

*Primary Examiner* — Kien T Nguyen
(74) *Attorney, Agent, or Firm* — Alston & Bird LLP

(57) ABSTRACT

A launched swing amusement ride has a carrier (100) for carrying a rider, wherein the carrier is suspended to swing from a support (400) by at least one elongate suspension member (413, 423) and is arranged to swing in more than one direction along an arcuate path, the arcuate path having a lowest point; a launch mechanism (200) located outside of the arcuate path; and a tether (300) that is arranged to releasably couple the carrier (100) to the launch mechanism to accelerate the carrier (100) in a first direction through a portion of the arcuate path between an engagement position and a release position, and to decouple the carrier (100) from the launch system (200) at the release position to propel the carrier (100) on an upward trajectory on the arcuate path.

23 Claims, 14 Drawing Sheets

(58) Field of Classification Search
USPC ..... 472/45–47, 49, 50, 118–125
See application file for complete search history.

(56) References Cited

U.S. PATENT DOCUMENTS

| | | | | | |
|---|---|---|---|---|---|
| 5,649,866 | A * | 7/1997 | Balwanz | A63G 9/00 | 472/118 |
| 6,126,552 | A * | 10/2000 | Harrap | A63G 9/00 | 472/118 |
| 6,440,002 | B1 * | 8/2002 | Jackson | A63G 31/00 | 472/118 |
| 6,875,118 | B1 | 4/2005 | Checketts | | |
| 7,066,822 | B2 * | 6/2006 | Cochron | A63G 31/00 | 472/118 |

* cited by examiner

AMUSEMENT RIDE

CROSS REFERENCE TO RELATED APPLICATIONS

This application is a National Stage Application, filed under 35 U.S.C. § 371, of International Application No. PCT/NZ2017/050158, filed Dec. 8, 2017, which claims priority to New Zealand Application No. 727536, filed Dec. 14, 2016; the contents of both of which as are hereby incorporated by reference herein in their entirety.

BACKGROUND

Related Field

This invention relates to a swing-based amusement ride.

Description of Related Art

Large scale swing-type amusement rides are known in the art. Various versions of such rides are referred to in U.S. Pat. Nos. 5,267,906 and 5,527,223 to Kitchen and Bird.

The Kitchen and Bird patents generally disclose the winch-back of a swing carrier to an elevated tower from which the carrier is released to swing in a curved trajectory on a swing line suspended from a support structure. A similar arrangement is disclosed in Australian patents 65965/98 and 75360/96 to Fairmile Pty Ltd. Because the Kitchen and Bird and Fairmile Pty Ltd carriers are swung solely under the influence of gravity, the swing carrier must be winched-back to a significant release height to obtain a suitable maximum swing height. Because of the arcuate nature of the swinging movement of the carrier after it is released, that also requires the swing carrier to be winched-back over a substantial horizontal distance, to obtain the desired release height.

The winch-back process has the advantage of enhancing rider anticipation as the rider and carrier are relatively slowly elevated to the release height. The process, however, may also be relatively time consuming in the context of the overall ride experience. This reduces the potential throughput of the ride and thereby the return on investment for the ride operator. In addition, these systems require the construction or availability of a launch tower or other structure which is additional to the support structure and is positioned a significant distance from the support structure.

What is required but not found in the prior art is an alternative means of elevating the swing carrier to the desired maximum swing height that is less time consuming and does not require the construction or availability of an additional launch structure.

In addition, in order to provide the public with a meaningful choice of ride experiences, it would be desirable to provide for a high-speed launch arrangement whereby the swing carrier can be launched from at or near ground level at high velocity to rapidly attain the desired maximum swing height. The rapid acceleration of the swing carrier in lieu of the relatively slow winch-back process will add to the desired excitement and thrill of the ride for some riders.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

It is an object of at least preferred embodiments of the present invention to provide a launched swing amusement ride that achieves one or more of the above outcomes, and/or to at least provide the public with a useful alternative.

BRIEF SUMMARY OF THE INVENTION

In accordance with an aspect of the present invention, there is provided a launched swing amusement ride comprising: a carrier for carrying a rider, wherein the carrier is suspended to swing from a support by at least one elongate suspension member and is arranged to swing in more than one direction along an arcuate path, the arcuate path having a lowest point; a launch mechanism located outside of the arcuate path; and a tether that is arranged to releasably couple the carrier to the launch mechanism to accelerate the carrier in a first direction through a portion of the arcuate path between an engagement position and a release position, and to decouple the carrier from the launch system at the release position to propel the carrier on an upward trajectory on the arcuate path.

In an embodiment, the tether is releasably coupled to the carrier.

In an embodiment, the tether is connected to a tether arresting member arranged to restrict the movement of the tether following its release from the carrier. In an embodiment, the tether arresting member comprises a flexible member.

In an embodiment, a tether retraction device is operatively connected to the launch mechanism and is arranged to retract the tether when it is released from the carrier.

In an embodiment, the tether is releasably coupled to the launch mechanism. In an embodiment, a tether retraction device is operatively connected to the carrier and is arranged to retract the tether when it is released from the launch mechanism.

In an embodiment, a first end of the tether is coupled to the carrier, a second end of the tether is coupled to the launch mechanism, and an intermediate portion of the tether is arranged to be decoupled. In an embodiment, a first tether retraction device is operatively connected to the carrier and a second tether retraction device is operatively connected to the launch mechanism, wherein the first and second tether retraction devices are arranged to retract respective portions of the tether when the intermediate portion of the tether is decoupled.

In an embodiment, the tether comprises a flexible member. In an alternative embodiment, the tether comprises a rigid member.

In an embodiment, the launch mechanism comprises a driven, elongate member extending between pulleys, wherein the elongate member is releasably coupled to the carrier by the tether and is positioned beneath and/or to a side of the arcuate path. In an embodiment, the launch mechanism further comprises an energy source that is operatively connected to the elongate member to drive the elongate member. In an embodiment, the launch mechanism comprises a flywheel adapted to store energy, the energy source to rotate the flywheel, and a first selective energy transfer mechanism operatively connected to the flywheel, wherein the first selective energy transfer mechanism is operable to transfer energy from the flywheel to the elongate member to accelerate the carrier along the portion of the arcuate path. In alternative embodiments, the energy source could be any other suitable energy source, such as a linear induction motor or mechanical motor for example. In an embodiment, activation of the first selective energy transfer mechanism results in rotation of at least one of the pulleys, to accelerate the carrier along the portion of the arcuate path.

In an embodiment, the first selective energy transfer mechanism comprises a mechanical clutch, an epicyclic gearbox, or a hydraulic motor.

In an embodiment, the ride further comprises a pull-back winch that is releasably coupled to the carrier. In an embodiment, the pull-back winch is arranged to pull the carrier in a second direction along the arcuate path to a start position that is higher than the lowest point of the arcuate path. In an embodiment, the start position is the same as the engagement position. In another embodiment, the start position is higher than the engagement position.

In an embodiment, the pull-back winch is driven independently of the energy source. In an alternative embodiment, the pull-back winch is operatively connected to one of the pulleys to enable the pull-back winch to be selectively driven by the energy source. In an embodiment, the pull-back winch is operatively connected to the flywheel via a reversing gearbox.

In an embodiment, the amusement ride further comprises a push-back mechanism that is releasably coupled to the carrier, wherein the push-back mechanism is arranged to push the carrier in a second direction along the arcuate path to a start position that is higher than the lowest point of the arcuate path. In an embodiment, the start position is the same as the engagement position.

In an embodiment, the tether is rigid and forms part of the push-back mechanism to push the carrier in the second direction along the arcuate path to the start position. In an alternative embodiment, the push back mechanism may comprise a push-back member that is separate from the tether and independently driven, the push-back member arranged to push the carrier in the second direction along the arcuate path to the start position.

In an embodiment, the launch mechanism is located beneath the lowest point of the arcuate path. Additionally or alternatively, the launch mechanism may be located to the side of the lowest point of the arcuate path.

In an embodiment, the launch mechanism is located substantially at ground level.

In an embodiment, the launch mechanism is arranged to begin accelerating the carrier when the carrier is positioned at the engagement position along the arcuate path. In an embodiment, the engagement position is at an angle of between about 15° and about 45° in a second direction relative to the lowest point of the arcuate path. In an embodiment, the engagement position is at an angle of about 30° in the second direction relative to the lowest point of the arcuate path.

In an embodiment, the release position is at an angle of between about 15° and about 45° in the first direction relative to the lowest point of the arcuate path. In an embodiment, the release position is at an angle of about 30° in the first direction relative to the lowest point of the arcuate path.

In an embodiment, the carrier is arranged to reach a maximum height when the direction of travel of the carrier changes from the first direction to a second direction, after being launched from the launch mechanism. In an embodiment, the maximum height is about 40 m above the launch mechanism. In an embodiment, the maximum height is greater than about 40 m, and may be significantly greater than about 40 m, such as about 50 m, 60 m, or higher.

In an embodiment, the maximum height is reached when the carrier is at an angle of about 100° in the first direction relative to the lowest point of the arcuate path.

In an embodiment, the elongate suspension member comprises a cable or a plurality of cables. In an embodiment, the cable(s) is/are about 30 m long.

In an alternative embodiment, the elongate suspension member could be a rigid elongate member or a plurality of rigid elongate members that is/are pivotally connected to the structure.

In an embodiment, the carrier is suspended from a single support tower. In an alternative embodiment, the carrier is suspended between two adjacent support towers, one on either lateral side of the arcuate path and the carrier.

In an embodiment, the support comprises one or more elongate support members, wherein the elongate suspension member(s) hang from the elongate support member(s). In an embodiment, the elongate support member(s) comprise one or more member(s) that extend(s) generally transversely to a longitudinal direction of the elongate suspension member(s).

In an embodiment, the carrier is arranged to support one rider. In an alternative embodiment, the carrier is arranged to support a plurality of riders.

In an embodiment, the carrier comprises one or more rider support(s), and the rider support(s) is/are configured to rotate relative to the elongate suspension member(s) at or near an end of each swing arc so that rider(s) supported by the rider support(s) face forward throughout at least a major part of each swing arc.

In an embodiment, the carrier is steerable after the initial launch by the launch mechanism. In an embodiment, the carrier is provided with a controllable rudder or similar steering device to enable the rider(s) to control the direction of swinging of the carrier after the initial launch by the launch system. In an embodiment, the rudder is controllable by a steering input device such as a rider-operable control stick or other controller. Additionally, or alternatively, the carrier may be provided with a rider-operable power source such as a propeller for example, to enable the rider to control the magnitude of swinging after the initial launch by the launch system.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

This invention may also be said broadly to consist in the parts, elements and features referred to or indicated in the specification of the application, individually or collectively, and any or all combinations of any two or more said parts, elements or features.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting. Where specific integers are mentioned herein which have known equivalents in the art to which this invention relates, such known equivalents are deemed to be incorporated herein as if individually set forth.

As used herein the term '(s)' following a noun means the plural and/or singular form of that noun.

As used herein the term 'and/or' means 'and' or 'or', or where the context allows both. The invention consists in the foregoing and also envisages constructions of which the following gives examples only.

BRIEF DESCRIPTION OF THE FIGURES

The present invention will now be described by way of example only and with reference to the accompanying drawings in which.

DETAILED DESCRIPTION OF VARIOUS EMBODIMENTS

Figure 1:
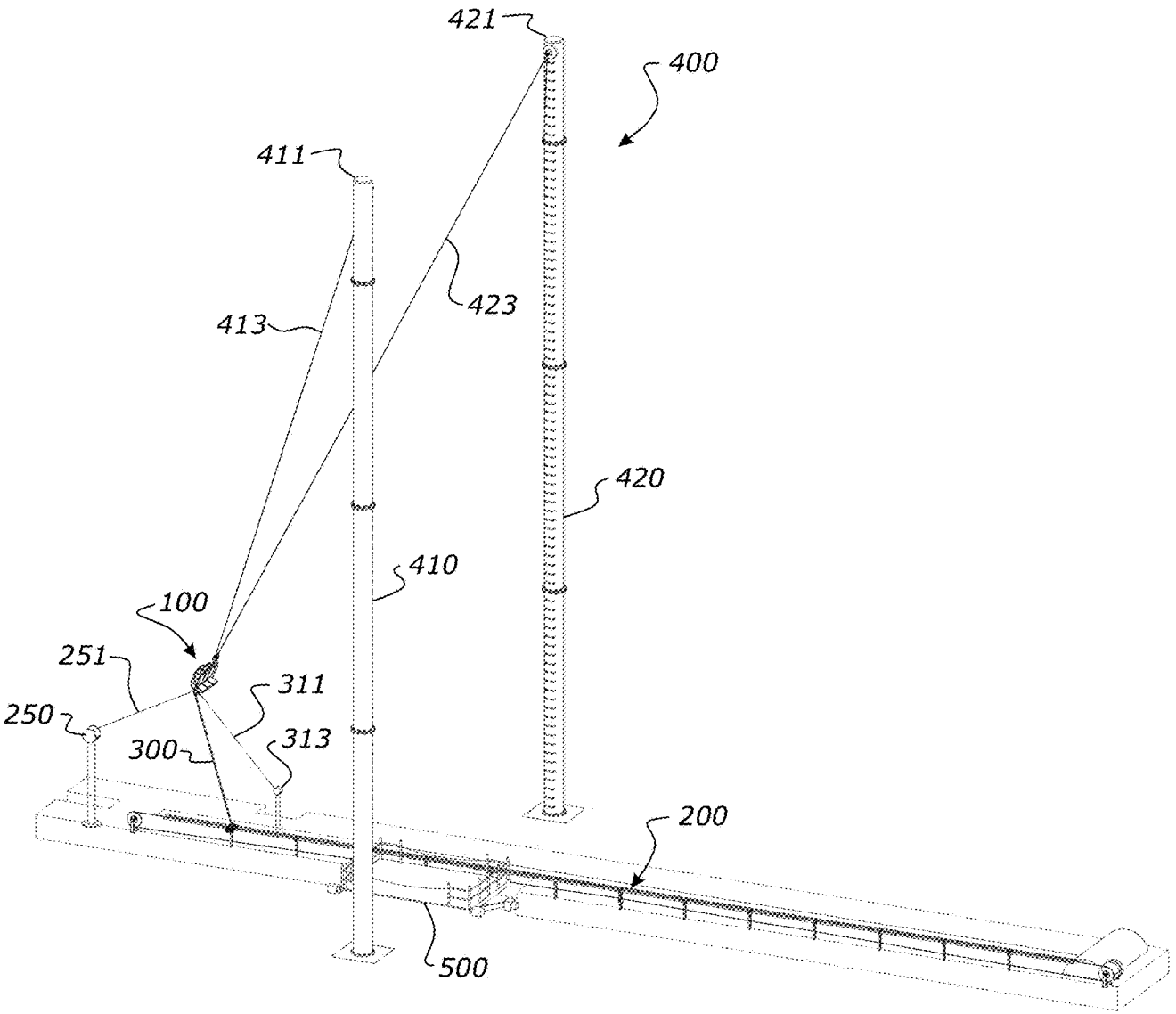
FIG. 1 is a perspective view of an exemplary embodiment launched swing amusement ride, showing the carrier in a pull-back/start position.

With reference to FIG. 1, an exemplary embodiment of the launched swing amusement ride is shown. The amusement ride comprises a carrier 100 for carrying at least one rider, a launch mechanism 200, and a tether 300. The carrier 100 is suspended to swing from a support 400.

The carrier 100 is releasably coupled to the launch mechanism 200 via the tether 300, such that the carrier 100 is accelerated by the launch mechanism 200 to a release point 3 (FIG. 2) where the tether 300 decouples from the carrier 100, thereby launching the carrier 100 on an upward trajectory in a first direction 150 along an arcuate path AP. After the highest point 4 of the arcuate path AP is reached at the end of the first swing arc, the carrier swings back in an opposite second direction 160 along the arcuate path. The carrier continues to swing back and forth in swing arcs along the first direction 150 and the second direction 160 until the carrier comes to a stop at the lowest position of the arcuate path.

In an embodiment, the carrier 100 can swing back and forth about a pivot along a substantially two-dimensional arcuate path AP in the first and second directions, with a pendulum-like swinging motion.

In an alternative embodiment, the carrier 100 can swing substantially freely about a pivot in three dimensions, i.e. along a partially spherical path. The carrier 100 may comprise controls to allow a rider to change the direction of the swinging arc such that the carrier 100 follows a partially spherical path, for example. The carrier controls may comprise a propeller and a rudder.

The swinging movement of the carrier 100 is substantially solely along one or more arcuate paths.

Carrier

Figure 6A:
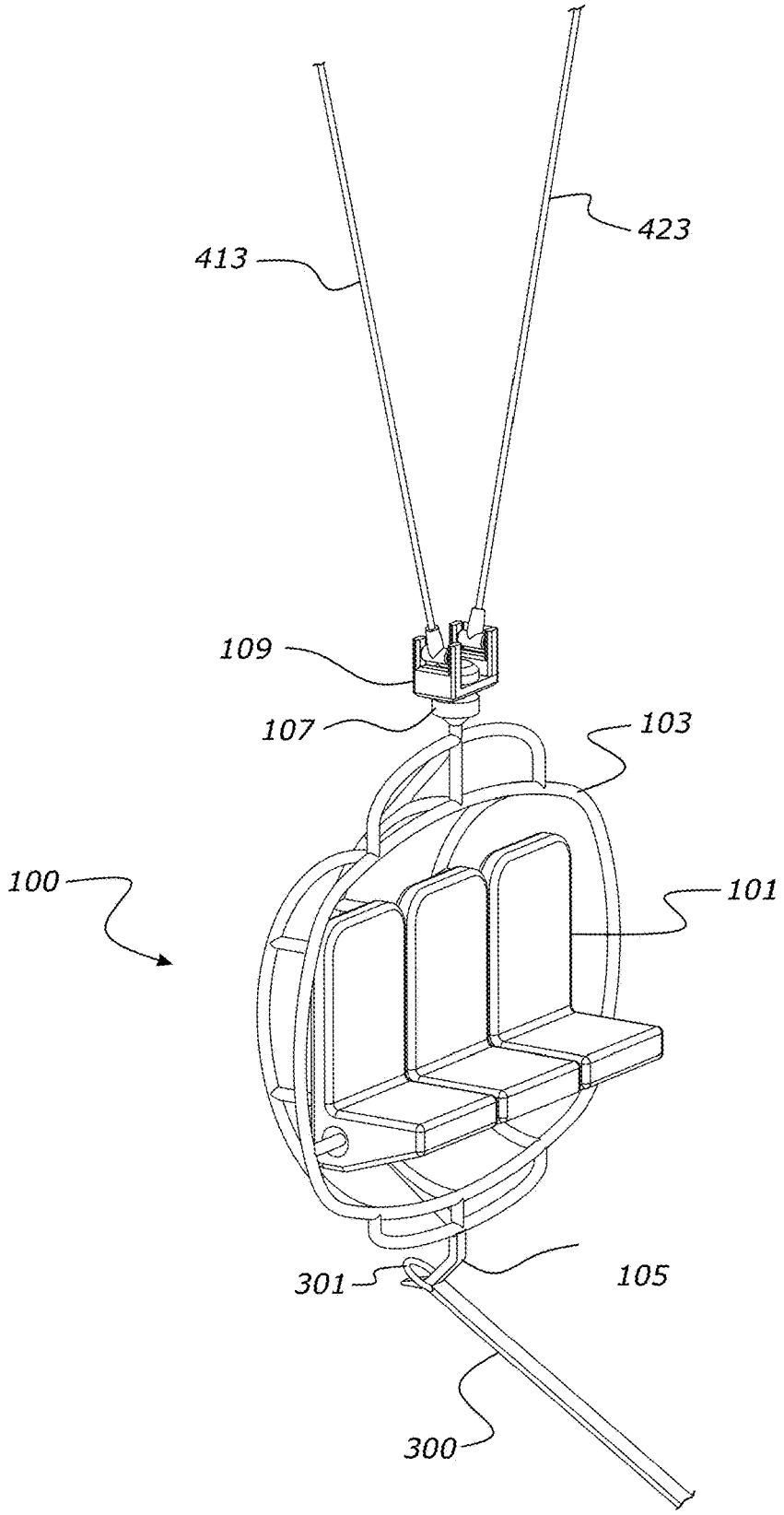
FIG. 6A is a perspective view of an exemplary carrier of the ride.
Figure 6B:
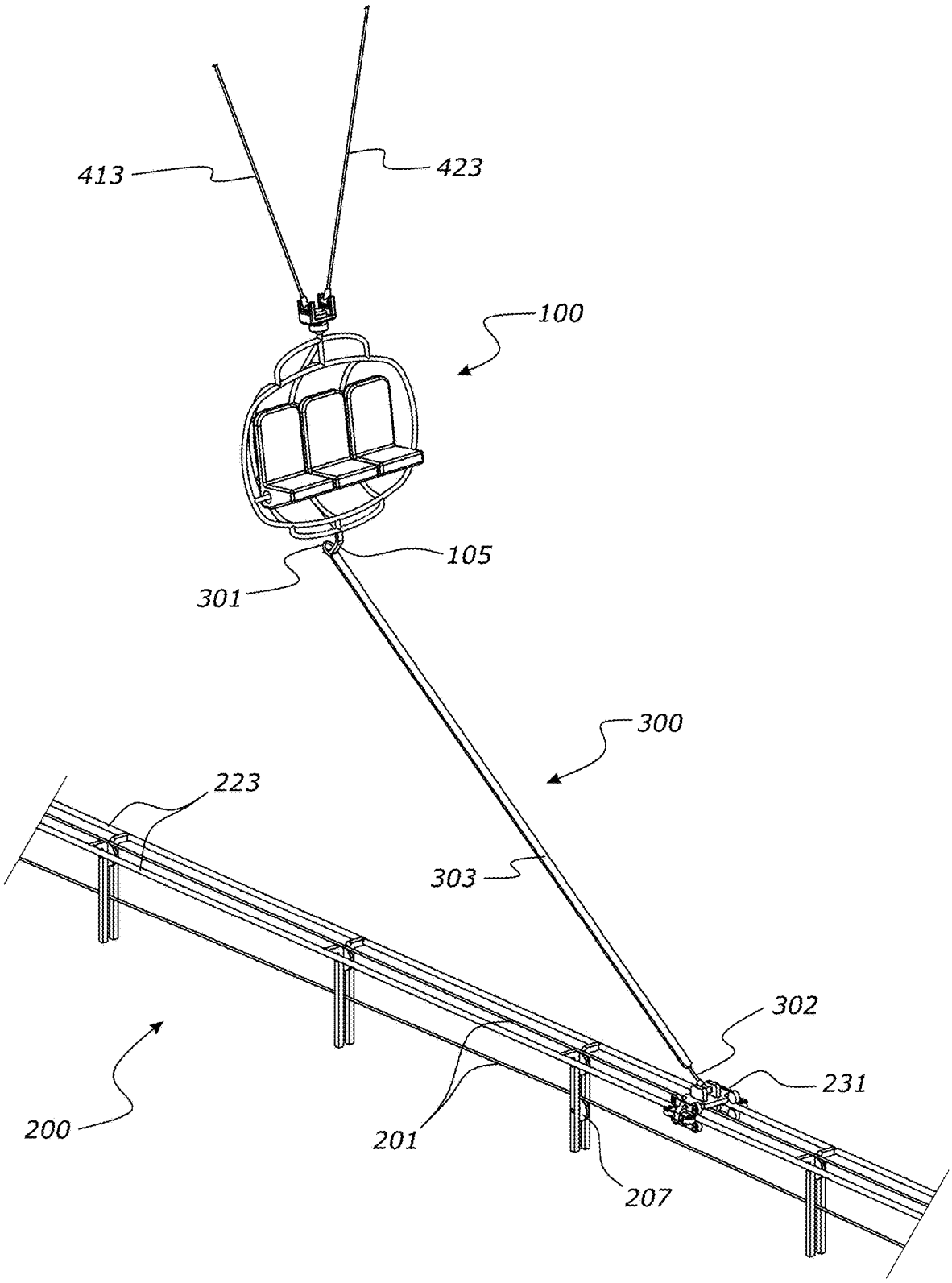
FIG. 6B is a perspective view of the carrier of FIG. 6*a* when the carrier is being accelerated by the launch mechanism.

FIGS. 6A and 6B show an exemplary embodiment of the carrier 100 arranged to support three riders. The carrier 100 comprises rider supports in the form of seats 101, a frame 103, a tether hook 105 and a carrier attachment 107.

In an alternative embodiment, the carrier 100 may be arranged to support one rider. In further alternative embodiments, the carrier 100 may be arranged to support a plurality of riders, for example, two, four, five or more riders.

The seats 101 are of known type and comprise harnesses of a known type (not illustrated). The seats 101 are fixed to the frame 103. In alternative embodiments, the seats 101 may be rotatable relative to the frame 103. The carrier will be made of materials that are suitably weather resistant; for example, a galvanised steel frame and vinyl seats.

The tether hook 105 is located at the bottom of the frame 103. The tether hook 105 is arranged to releasably engage with the tether 300. The tether hook 105 is arranged such that the open end of the hook is directed towards the back of the carrier 100 to provide passive releasable engagement with the tether 300. In alternative embodiments, the tether hook 105 may comprise an actively controlled hook to releasably engage with the tether 300.

The carrier attachment 107 is located at the top of the frame 103. The carrier attachment 107 is coupled to the suspension attachment 109. The carrier attachment 107 is rotatable relative to the suspension attachment 109. In alternative embodiments, the carrier attachment 107 may be fixed relative to the suspension attachment 109.

In the configuration shown, the carrier is configured to support the rider(s) in a forward-facing upright seated orientation. In alternative configurations, the carrier may be configured to support the rider(s) in other orientations, such as forward- or rearward-facing prone orientations, either upwardly- or downwardly-facing for example.

Figure 7A:
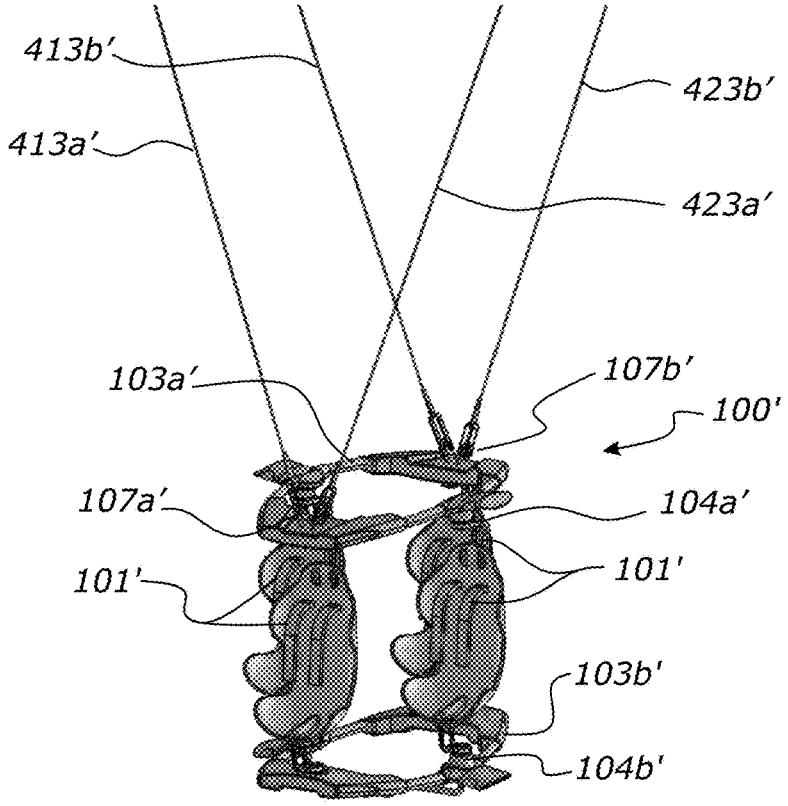
FIG. 7A is a front left side perspective view of an alternative exemplary carrier with rotatable rider supports.
Figure 7B:
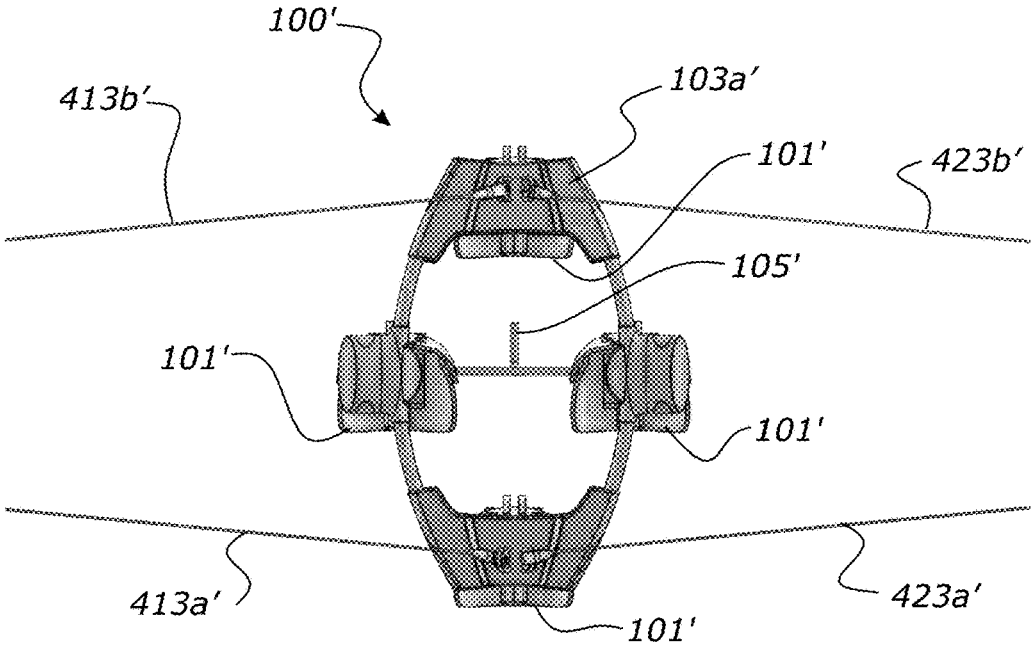
FIG. 7B is an overhead plan view of the carrier of FIG. 7A.
Figure 7C:
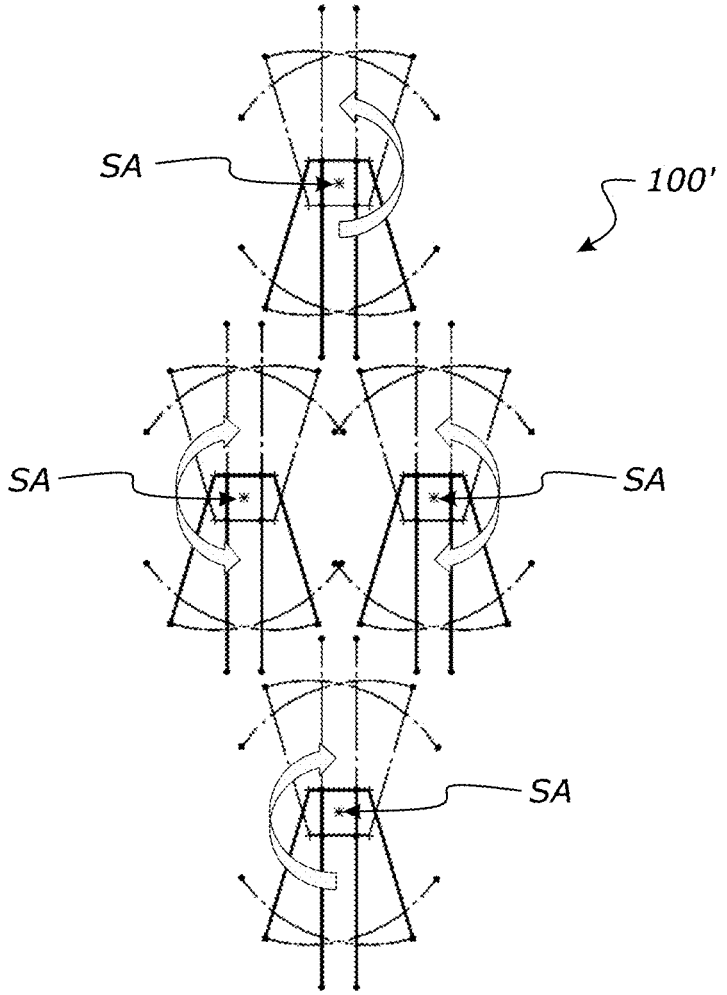
FIG. 7C is a schematic overhead plan of the carrier of FIG. 7A showing exemplary rotation directions of the rider supports.

FIGS. 7A to 7C show an alternative exemplary embodiment carrier 100' for supporting a plurality of riders that can be used in the amusement ride. Unless described below, the features, functionality, and alternatives are the same as for the carrier 100 of FIGS. 6A and 6B, and like reference numerals are used to indicate like parts, with the addition of a prime (').

In this embodiment, the carrier 100' comprises four rider supports in the form of seats 101', a frame comprising an upper frame member 103*a*' and a lower frame member 103*b*', a tether hook 105, and carrier attachments 107*a*', 107*b*'. The carrier 100' is suspended to swing from the support 400 by elongate suspension members 413*a*', 413*b*' 423*a*', 426*b*', in a similar manner described below for carrier 100 under the Support heading. In the embodiment shown, the carrier 100' is suspended by two left side elongate suspension members 423*a*', 423*b*' and two right side elongate suspension members 413*a*', 413*b*' to inhibit rotation of the upper frame member 103*a*' relative to the elongate suspension members.

Each seat 101' is rotatably coupled to the upper and lower frame members 103*a*', 103*b*' by upper and lower rotation couplings 104*a*', 104*b*'. One of the upper and lower rotation couplings may comprise a motor, such as a hydraulic or electric motor, to drive rotation of the seat 101' relative to the frame members 103*a*', 103*b*', and thereby relative to the suspension members 413*a*', 413*b*', 423*a*', 423*b*', about a respective axis SA that extends through the upper and lower rotation couplings 104*a*', 104*b*'. The other of the upper and lower rotation couplings may comprise a bearing, or may comprise a corresponding motor that is synchronised with the other motor so the rotational drive is provided to both the top and the bottom of each seat.

The rider support seats 101' are configured to rotate relative to the upper and lower frame members 103*a*', 103*b*' and thereby relative to the elongate suspension member(s), at or near an end of each swing arc, so that rider(s) supported by the rider support(s) face forward throughout at least a major part of each swing arc, and advantageously throughout substantially the entirety of each swing arc. For example, with reference to FIG. 2, the riders may face forward (towards the right of the page) in the first swing direction until the carrier 100' reaches or is close to point 4. An accelerometer or other sensor coupled to the carrier 100 could determine when point 4 has been reached, and a controller that is in communication with the accelerometer/sensor will actuate the motors to cause the seats 100' to rotate through 180 degrees, so the riders then face forward (towards the left of the page) during the swing in the second direction. This will repeat at or near the top of that reverse swing so that the riders face forward (towards the right side of the page) during the swing in the first direction, and so on. The process may repeat until the carrier 100' stops swinging. The seats 101' could change direction before, at, or after the change in swing direction.

As shown in FIG. 7C, the two outer rider supports 100' will be configured so that they only rotate outwardly, so prevent the legs of those two riders from contacting each other and interfering with the rotation of the seats.

Power may be supplied to the motors via the elongate suspension members so that a separate power source does not need to be carried by the carrier 100'. The seat mechanisms may incorporate end stops to limit rotation of the seats. The direction of rotation of the seats will automatically reverse for each operation, based on sensors that determine the current seat position. Alternatively, the front and rear rider supports may rotate in one direction only, each time rotation occurs.

Although the rider support rotation feature is described with reference to a carrier 100' that has four rider support seats 101', the rider support rotation feature could alternatively be implemented in a carrier having any suitable number of rider supports, such as 1, 2, 3, 4, or more rider supports. It could also be implemented in a carrier having rider support(s) that support rider(s) in different positions (e.g. prone positions) and/or different directions.

As another example, rather than having independent rotation of each rider support 101', the overall carrier 100, 101' may be configured to rotate relative to the suspension member(s). For example, a motor could be provided between the carrier attachment 107 and the suspension attachment 109 in the carrier 100 of FIG. 6A, to cause the entire carrier to rotate at or near the end of each swing arc.

Support

The carrier 100 is suspended to swing from a support 400. In the form shown, the support comprises a support structure 400. The carrier 100 is arranged to swing from the support structure 400 in more than one direction along an arcuate path AP, the arcuate path having a lowest point in which the carrier is positioned closest to the elongate member 201 of the launch mechanism.

Figure 12:
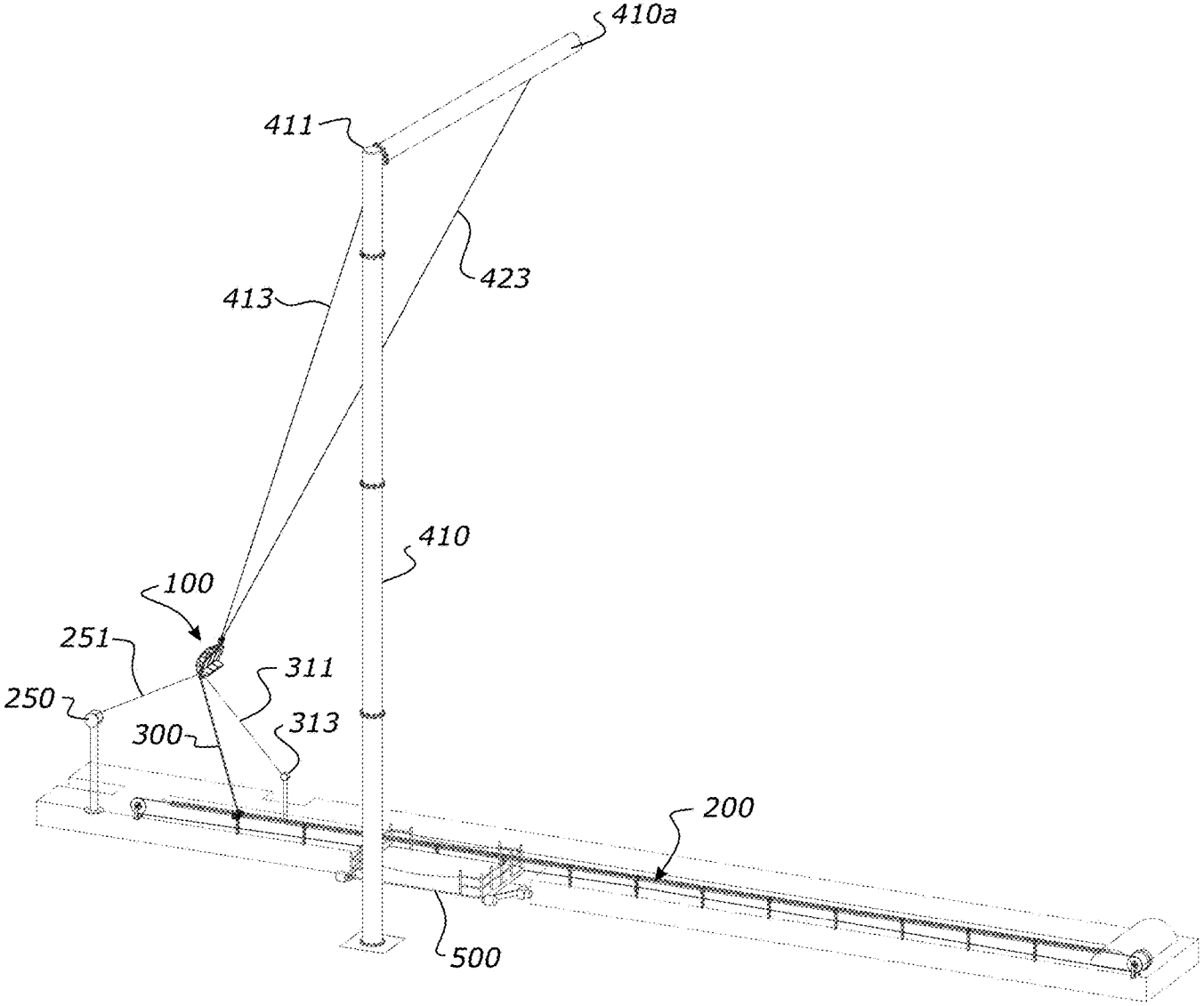
FIG. 12 is a perspective view of an exemplary embodiment launched swing amusement ride with a single support tower, showing the carrier in a pull-back/start position.

FIG. 1 shows an exemplary embodiment wherein the carrier 100 is suspended between two adjacent vertically-extending upright support towers 410, 420, one positioned on either lateral side of the arcuate path AP and the carrier 100. In an alternative embodiment shown in FIG. 12, the carrier 100 is suspended from a single support tower 410. For example, the single support tower may comprise a single vertically-extending upright support tower 410 and a cantilevered extension 410*a* from the top of the support tower, with the carrier suspended to swing from the cantilevered extension by one or more elongate suspension members.

In another alternative embodiment, the support may comprise one or more elongate support members such as cable(s), rope(s), or line(s) for example, and the carrier 100 is suspended to swing from the elongate support member(s) by one or more elongate suspension members 413, 423 that hang from the elongate support member(s). The elongate support member(s) may comprise one or member(s) that extend(s) generally transversely to a longitudinal direction of the elongate suspension member(s). The elongate support member(s) may be suspended between support towers or may be suspended across a natural feature such as a gully.

The support towers 410, 420 comprise cable pivots 411, 421 located at or adjacent the highest point of the towers. One elongate suspension member 413, 423 is shown on each side of the carrier 100. Alternatively, two or more elongate suspension members may extend from each cable pivot 411, 421 to the carrier 100. Elongate suspension members 413, 423 are rotatably engaged with the cable pivots 411, 421. The elongate suspension members 413, 423 are made from flexible members such as steel cable or another suitable weather resistant material. The elongate suspension members 413, 423 comprise a cable or a plurality of cables. In an alternative embodiment the elongate suspension members may be rigid members.

The elongate suspension members 413, 423 are about 30 m long. In alternative embodiments the elongate suspension members may be longer or shorter, for example 10 m, 20 m or 40 m long.

The distal ends of the elongate suspension members 413, 423 are coupled to the suspension attachment 109. The suspension attachment 109 connects the swing cables 413, 423 with the carrier 100 via the carrier attachment 107.

The carrier 100 swings about the pivots at the upper ends of the elongate suspension members.

Launch Mechanism

Figure 2:
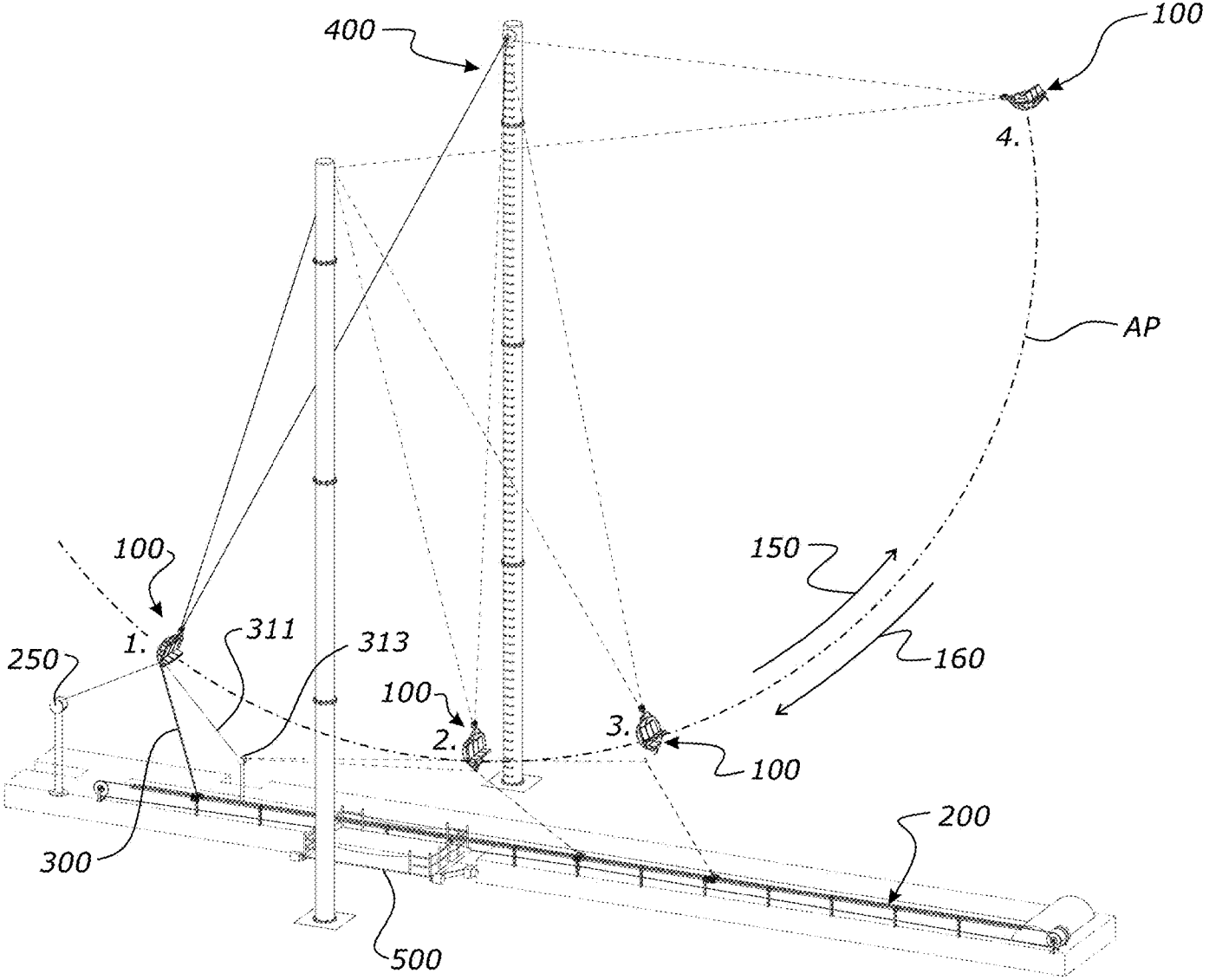
FIG. 2 is a view similar to FIG. 1, showing a dynamic overview of the ride.

FIG. 2 shows the four sequential stages of launching the carrier 100:

1. Pull-back/start position
2. Acceleration
3. Release
4. Swing.

Figure 3:
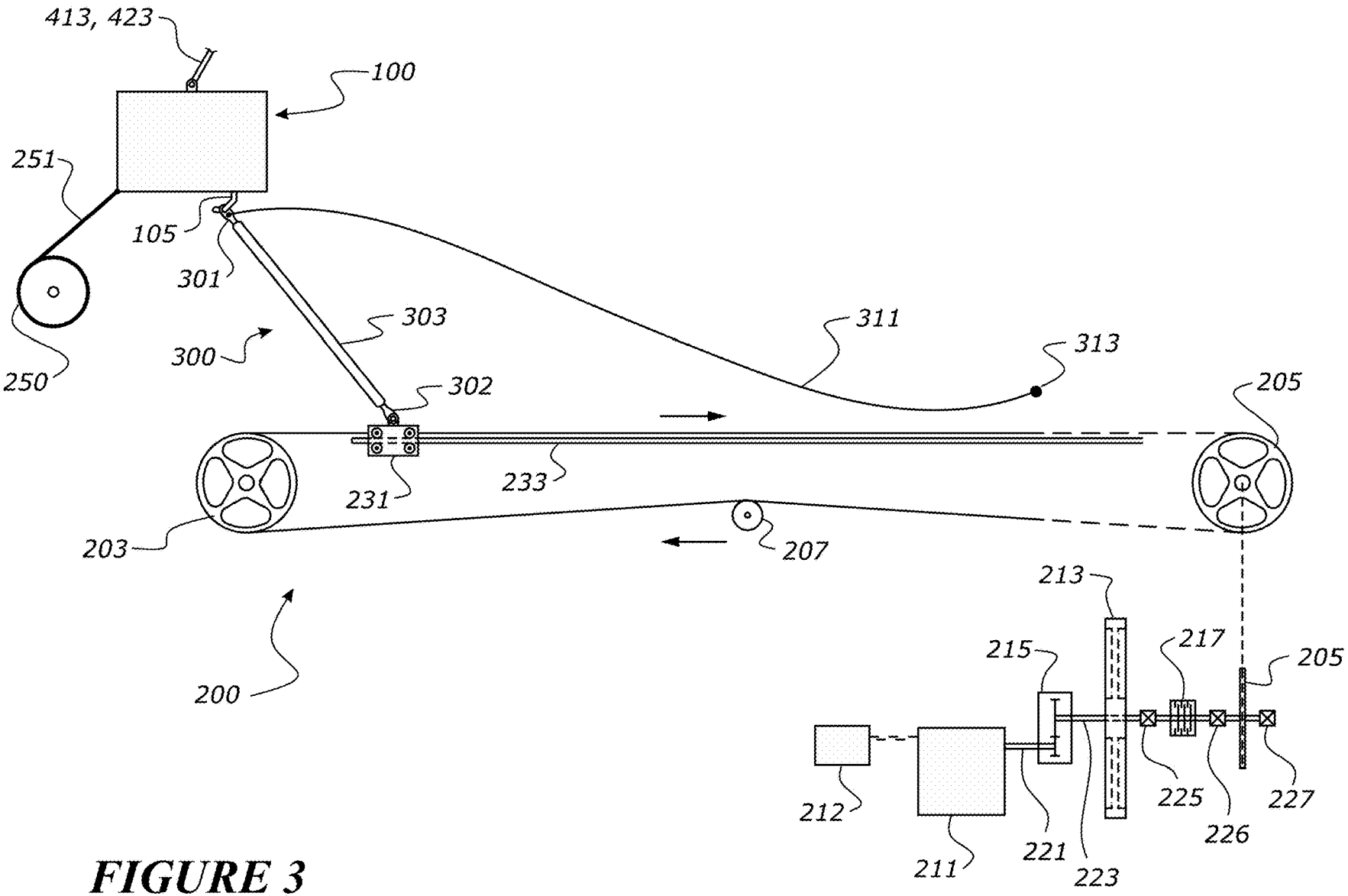
FIG. 3 is a side view of an exemplary embodiment launch system when the carrier is in the pull-back/start position, where broken lines represent discontinuation of the launch member which is not shown at full length.
Figure 4:
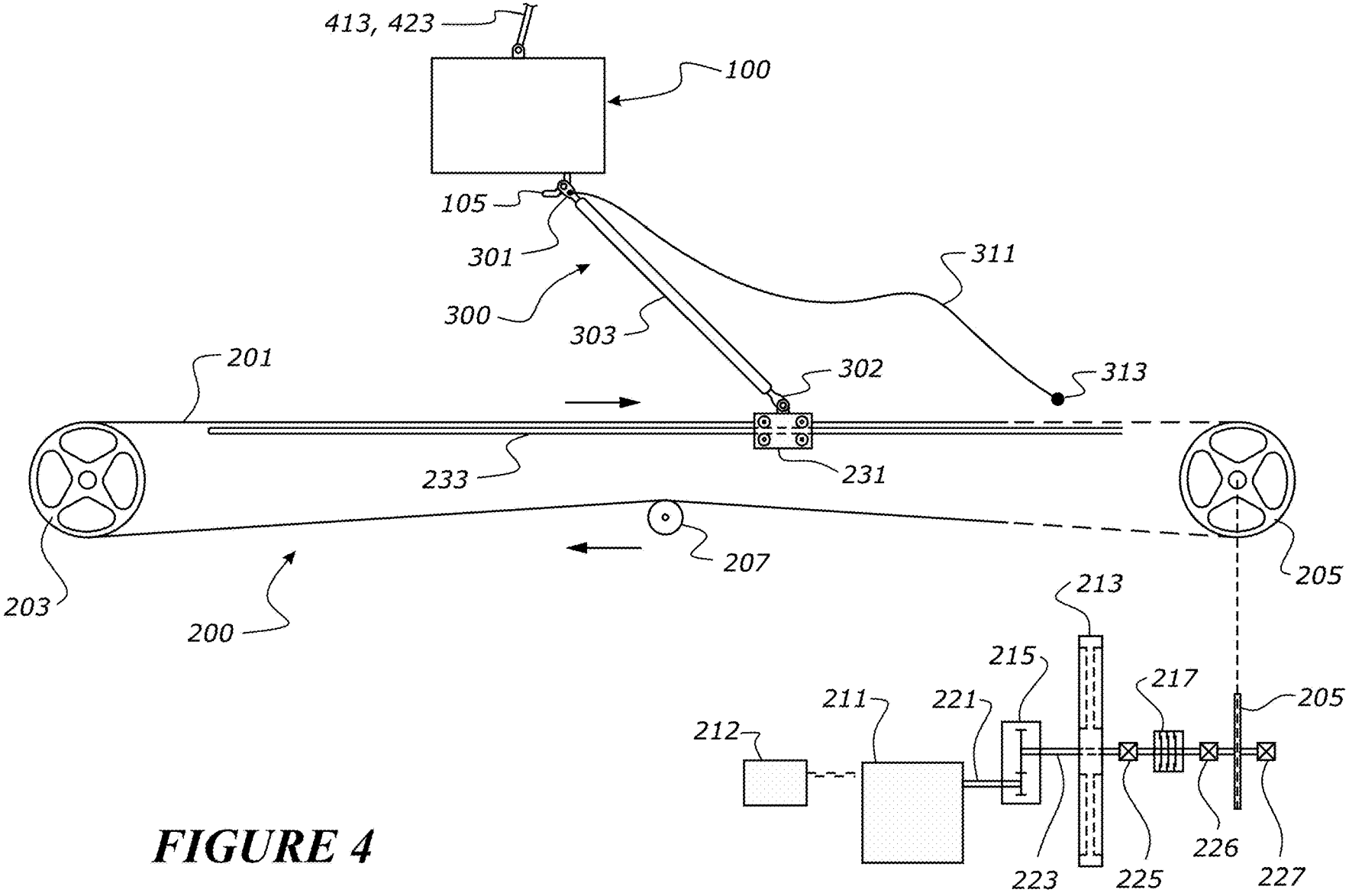
FIG. 4 is a view similar to FIG. 3 when the carrier is being accelerated, where broken lines represent discontinuation of the launch member which is not shown at full length.
Figure 5:
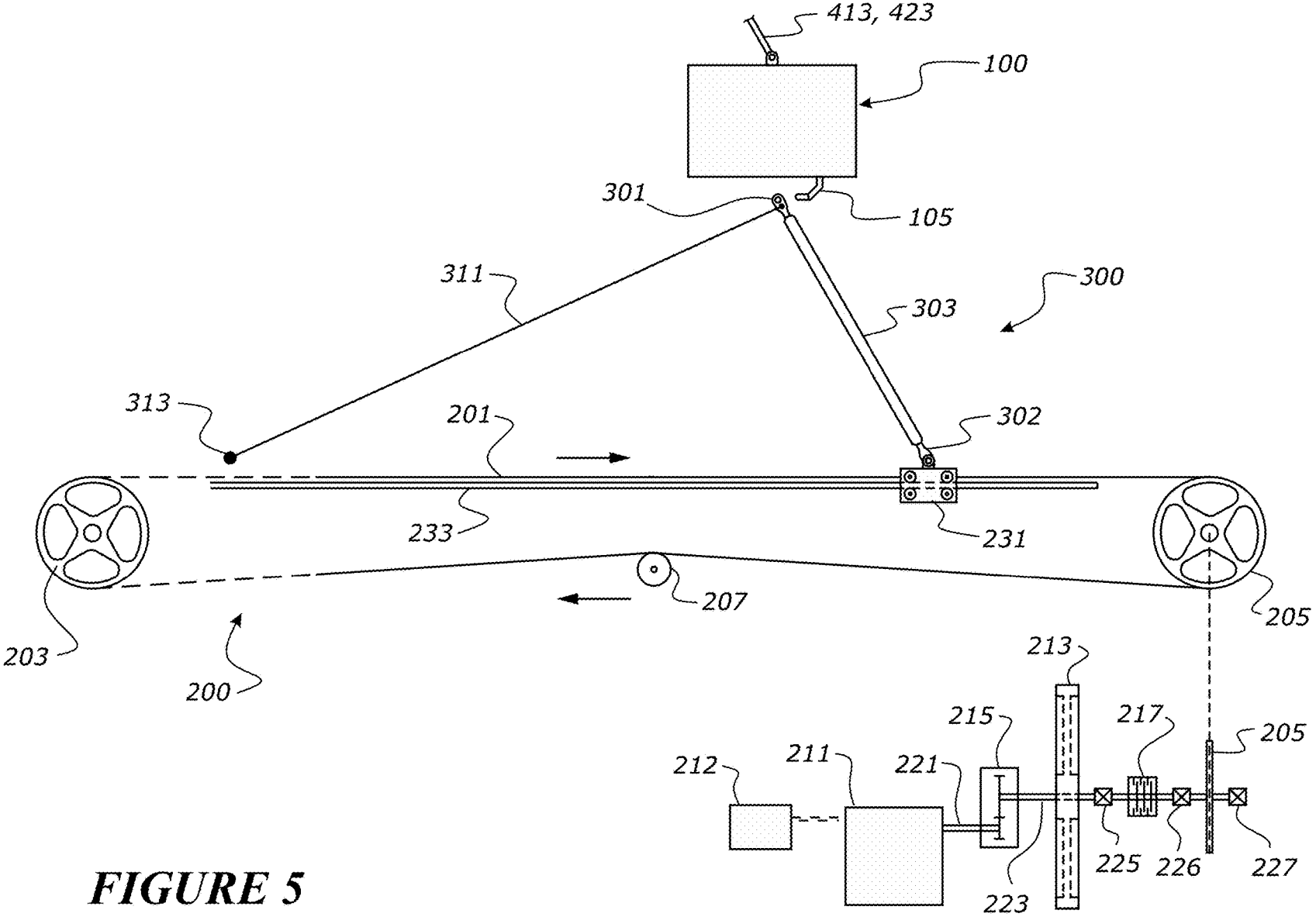
FIG. 5 is a view similar to FIGS. 3 and 4 when the carrier is being released from the launch system, where broken lines represent discontinuation of the launch member which is not shown at full length.

FIGS. 3-5 show detail of stages 1-3 respectively.

The launch mechanism 200 is located outside of the arcuate path AP of the carrier. In the form shown, the launch mechanism is positioned substantially at ground level, and may be at least partially buried in the ground. Alternatively, the launch mechanism may be positioned above ground level. The launch mechanism may be positioned beneath the arcuate path AP, to the side of the arcuate path AP, or both beneath and to the side of the arcuate path AP.

Referring to FIGS. 3-5, the launch mechanism 200 comprises a driven, elongate member 201 such as a launch cable, conveyor, or belt. The launch member could be any suitable material such as steel or ultra-high-molecular-weight polyethylene. The launch member 201 extends between two pulleys 203, 205. The pulley 205 is rotatably supported by suitable bearings 226, 227. The pulley 203 is rotatably supported by similar suitable bearings (not shown).

The launch member 201 is releasably coupled to the carrier 100 by the tether 300 and is positioned beneath and/or to a side of the arcuate path. An energy source 211 is operatively connected to the launch member 201 to drive the launch member 201. The energy source 211 is controlled by motor controller 212. The launch mechanism is independent of the carrier 100 and independent of the elongate suspension members(s) 413, 423.

The launch mechanism 200 comprises a flywheel 213 adapted to store energy and an energy source 211 to rotate the flywheel 213. The energy source 211 may be an internal combustion motor, diesel generator, electric motor, linear induction motor; or any other suitable energy source. In the form shown, the energy source 211 is coupled to gearbox 215 via gearbox shaft 221. The gearbox is coupled to the flywheel 213 via the flywheel shaft 223. Thus, the energy source 211 drives the flywheel 213. In an alternative embodiment, the energy source 211 drives the flywheel 213 via a rotatable member such as a tyre drive.

The flywheel shaft 223 is rotatably supported by bearings 225, 226, and 227.

A first selective energy transfer mechanism 217 is operatively connected to the flywheel 213. The first selective energy transfer mechanism 217 is operable to transfer energy from the flywheel 213 to the launch member 201 to accelerate the carrier 100 along the portion of the arcuate path.

The first selective energy transfer mechanism 217 is rotatably supported by bearings 225, 226.

Activation of the first selective energy transfer mechanism 217 results in rotation of at least one of the pulleys 203, 205, to accelerate the carrier 100 along a portion of the arcuate path AP.

In the form shown in FIGS. 3-5, first selective energy transfer mechanism 217 comprises a mechanical clutch. The clutch 217 is a hydraulically actuated fluid clutch. When hydraulic fluid is pressurised, the clutch will be engaged such that torque is transmitted from the flywheel to the respective carrier, via the clutch.

In alternative embodiments, the first selective energy transfer mechanism may comprise an epicyclic gearbox or a hydraulic motor.

A linear induction motor or other suitable motor could be used instead of the flywheel and energy source arrangement.

Pull-Back Winch

A pull-back winch 250 is releasably coupled to the carrier 100. The pull-back winch is positioned at a rear region of the launch mechanism 200, and may be mounted on a vertically extending upstand to position the pull-back winch higher than the launch mechanism. The pull-back winch 250 is arranged to pull the carrier 100 in the second direction 160 along the arcuate path to a pull-back/start position 1 that is higher than the lowest point of the arcuate path AP.

The pull-back winch 250 comprises pull-back winch cable 251. Pull-back winch cable 251 is releasably coupled to carrier 100.

In an alternative embodiment, the pull-back winch cable 251 can replace the tether-arresting member 311. In such an embodiment, the winch cable 251 may be connected to the tether 300. The tether hook 105 may comprise an actively controlled hook to releasably engage with the tether 300. The pull-back winch may be driven independently of the launch mechanism, such as via its own motor for example. Alternatively, the pull-back winch could be selectively driven by the flywheel 213, via a second selective energy transfer mechanism and reversing gearbox. The second selective energy transfer mechanism may comprise a mechanical clutch, an epicyclic gearbox, or a hydraulic motor.

Tether

The tether 300 is arranged to releasably couple the carrier 100 to the launch mechanism 200 to accelerate the carrier 100 in a first direction through a portion of the arcuate path between an engagement position and a release position 3, and to decouple the carrier 100 from the launch system 200 at the release position to propel the carrier 100 on an upward trajectory on the arcuate path.

The tether 300 may be any suitable length, such as 8 m for example. In other embodiments, the tether may be 5 m, 10 m, 15 m, or any other suitable length.

A first end 301 of the tether 300 is coupled to the carrier 100. A second end 302 of the tether 300 is coupled to the launch mechanism 200. The first end 301 and second end 302 are connected by an intermediate member 303 via launch bogie 231. Launch bogie 231 is slideably engaged with launch rail 233.

The tether 300 shown in FIGS. 3-5 is releasably coupled to the carrier 100. In an alternative embodiment, the tether 300 is releasably coupled to the launch mechanism 200. In a further alternative embodiment, the intermediate portion 303 of the tether is arranged to be decoupled. For example, about half of the intermediate portion 303 may remain connected to the carrier via the first end 301 following decoupling. The remaining part of the intermediate portion 303 may remain connected to the launch mechanism 200 via the second end 302 following decoupling.

In the embodiment shown in FIGS. 3-5, the tether 300 comprises a rigid member. In alternative embodiments, the tether 300 comprises a flexible member. The tether can be made from any suitable weather resistant and strong material, such as steel for example. Alternatively, where the tether comprises a flexible member, it may be made from a strong, lightweight material such as ultra-high-molecular-weight polyethylene rope for example.

The tether is connected to a tether arresting member 311 arranged to restrict the movement of the tether following its release from the carrier 100. In the embodiment shown in FIGS. 3-5, the tether arresting member 311 comprises a flexible member, such as a flexible cable.

An end of the tether arresting member 311 is fastened to a fixed anchor 313. The fixed anchor is stationary relative to the ground. An opposite end of tether arresting member 311 is fastened to the tether 300, at or adjacent the first end 301 of the tether 300.

An embodiment where the tether 300 comprises a flexible member may comprise a tether retraction device (not illustrated). The tether retraction device may be operatively connected to the launch mechanism 200. The tether retraction device may be arranged to retract the tether 300 when it is released from the carrier 100.

In an alternative embodiment, the tether retraction device may be operatively connected to the carrier 100. The tether retraction device may be arranged to retract the tether 300 when it is released from the launch mechanism 200.

In a further alternative embodiment, a first tether retraction device (not illustrated) may be operatively connected to the carrier 100 and a second tether retraction device (not illustrated) may be operatively connected to the launch mechanism 200. The first and second tether retraction devices are arranged to retract respective portions of the tether when the intermediate portion 303 of the tether 300 is decoupled.

Operation/Method of Use

Loading

Pull-back winch cable 251 and tether 300 are connected to the carrier 100. This may be accomplished before or after the rider or riders enter the carrier 100.

The rider or riders board the carrier 100 via the loading platform 500. The platform 500 will initially be lowered down to ground level to enable the riders to enter the platform 500. The platform 500 is then raised to the position shown in FIG. 7 to enable the riders to enter the carrier 100. The carrier 100 is at the lowest point of the arcuate path AP when the riders enter the carrier 100. The rider or riders are secured into their seats using harnesses (not shown).

A ride operator will be present on the platform to ensure that the riders are secured in the carrier 100 and to attach the pull-back winch cable 251 and the tether 300 to the carrier.

After the rider or riders have entered the carrier 100, the platform 500 is moved down and to the side of the arcuate path AP of the ride via hydraulically actuated arms 500, 502. A ride operator may control the ride from the platform 500.

An alternative type of loading platform 500 could be used, such as a scissor lift or a rollaway platform for example.

Pull-Back

After or at the same time as the platform 500 is moved away from the arcuate path AP, the pull-back winch 250 winds in the pull-back winch cable 251 in the second direction 160 to raise the carrier 100 to the rearward pull-back/start position 1, also shown in FIG. 3.

Acceleration

Acceleration begins with the release of the pull-back winch 250 at the start position. Either at the same time or slightly after, the launch bogie 231 is activated by engaging the first selective energy transfer mechanism 217 with the spinning flywheel 213.

FIG. 4 shows the launch mechanism during the acceleration phase. The launch mechanism 200 is arranged to begin accelerating the carrier 200 when the carrier 200 is positioned at the engagement position along the arcuate path.

The pull-back/start position shown in FIGS. 2 and 3 may be the same as the engagement position. The launch mechanism 200 begins to accelerate the carrier 100 at the same time as the pull-back winch cable 251 is released.

In an alternative embodiment, the pull-back/start position may be higher than the engagement position. In this embodiment, the carrier could be pulled back to the maximum (vertical) extent of the tether. When the pull-back winch cable 251 is released, the carrier 100 initially accelerates under the influence of gravity for a short period of time along a portion of the arcuate path before the launch mechanism 200 begins to accelerate the carrier. The period of time could be any suitable time depending on the required speed of the launch bogie, such as about one second or any other suitable time. After release, the tether 300 may be slack until the launch bogie 231 'catches up' with the carrier 100 and the launch mechanism accelerates the carrier 100. This may provide a smoother launch experience with less jarring for the riders.

The engagement position is at an angle of between about 15° and about 45° in the second direction 160 relative to the lowest point of the arcuate path.

In the embodiment shown in FIGS. 2 and 3, the engagement position is at an angle of about 30° in the second direction 160 relative to the lowest point of the arcuate path.

Release

The launch bogie 231 pulls the carrier 100 via the tether 300 to the release position where the tether 300 decouples from the carrier 100 as a result of the fixed length tether arresting member 311 stopping movement of the tether and pulling the tether from the suitably angled hook on the carrier, to allow the carrier 100 to swing on the arcuate path AP to a maximum height. The carrier 100 will be travelling at maximum velocity at the point of release.

Position 3 in FIG. 2 and FIG. 5 show the release position of the carrier where the tether 300 decouples from the carrier 100. The release position is at an angle of between about 15° and about 45° in the first direction 150 relative to the lowest point of the arcuate path AP.

In the embodiment shown in FIG. 5, the release position is at an angle of about 30° in the first direction 150 relative to the lowest point of the arcuate path AP.

After the carrier has been released, the launch bogie 231 is brought to a stop via a braking means on the launch rail 233 or the pulley 205 (not shown). Alternatively the bogie may be brought to a stop by means of tension on the tether 300 from the extended tether arresting member 311. The launch bogie 231 is then winched back to the start position by reversing the rotational direction of the pulleys 203, 205.

The tether 300 is contained by the tether arresting member 311 and is retrieved by the operator for the following launch.

Swing

The carrier will decelerate from the release point 3 to zero speed at the top point 4 of the swing. The carrier 100 is arranged to reach a maximum height when the direction of travel of the carrier 100 changes from the first direction 150 to the second direction 160, during the initial swing after being launched from the launch mechanism 200.

In the embodiment shown in the figures, the maximum height (position 4 of FIG. 2) is about 40 m above the launch mechanism 200. In alternative embodiments, the maximum height may be more or less than 40 m above the launch mechanism 200, for example about 10 m, 20 m, 30 m, 50 m or 60 m above the launch mechanism 200.

In the embodiment shown in the figures, the maximum height is reached when the carrier 100 is at an angle of about 100° in the first direction 150 relative to the lowest point of the arcuate path. In alternative embodiments the maximum height is reached when the carrier 100 is at a different angle, such as an angle of about 30°, 40°, 50°, 60°, 70°, 80°, 90°, 100° or 120° in the first direction 150 relative to the lowest point of the arcuate path.

After the highest point 4 of the arcuate path AP is reached, the carrier swings back in a second direction 160 along the arcuate path. Where the highest point 4 is above the horizontal plane, the carrier will initially fall substantially vertically inside the arcuate path for a brief period until it meets the arcuate path. The carrier continues to swing back and forth along the first direction 150 and the second direction 160 until the carrier comes to a stop at the lowest position of the arcuate path. If a carrier 100' with the rotation feature is used, the rider support 101' of the carrier will rotate at or near the end of each swing arc to reverse the facing directions of the riders.

After the carrier 100 has completed a number of swings along the arcuate path AP, a carrier brake (not shown) may be used to attenuate the swinging motion and bring the carrier 100 to a stop. The carrier brake may comprise an arresting cable that can be selectively raised above the launch rail to a height required to catch the hook under the carrier. Alternatively, a selective damping means may be provided on the elongate suspension members to attenuate the swinging motion.

The next riders enter the loading platform 500 either while the carrier 100 is swinging or after it has come to a stop. Once the carrier 100 has come to a stop, the platform 500 will then be raised to the position shown in FIG. 7 to enable the riders to exit the carrier 100 and for the next riders to enter the carrier 100. The initial riders are released from their seats and the next riders are secured in their seats. The platform 500 then lowers the initial riders to the ground and the ride procedure is repeated.

Table 1 outlines specifications relating to one exemplary embodiment of the ride. It will be appreciated that the specifications will change for differing embodiments.

TABLE 1

| Specifications of exemplary embodiment | |
|---|---|
| Length of elongate suspension members 413, 423 | 30 m |
| Length of tether 300 | 8 m |
| Angle of carrier 100 at pull-back/start position 1 | 30° |
| Angle of carrier 100 at lowest point of arcuate path | 0° |
| Angle of carrier 100 at release position 3 | −30° |
| Mass of carrier 100 | 600 kg |
| Mass of elongate suspension members 413, 423 | 0 kg |
| Mass of tether 300 | 0 kg |
| Mass of launch member 201 | 6.771 kg |
| Height at highest point of the arcuate path 4 | 40 m |
| Angle between tether 300 and suspension members 413, 423 at start position 1 | 120° |
| Total length of launch mechanism 200 | 45 m |
| Length of acceleration phase | 30 m |
| Bogie 231 braking distance | 7.5 m |
| Height of carrier 100 above launch mechanism 200 | 2.9 m |
| Distance between bogie 231 position at start position 1 and bogie 231 position when carrier 100 is at lowest point of arcuate path | 18.452 m |

The following assumptions were made:

The elongate suspension members 413, 423 and the tether 300 were assumed to be massless for simplified calculations.

The mass of the launch member 201 was estimated based on 10 mm diameter ultra-high-molecular-weight polyethylene rope with mass of 6.1 kg/100 m and break strength of 105.4 kN.

Table 2 outlines calculated properties relating to one exemplary embodiment of the ride based on the specifications outlined in table 1.

TABLE 2

| Calculated values for exemplary embodiment. | |
|---|---|
| Energy potential of carrier 100 at highest point 4 of arcuate path | 235, 440 J |
| Velocity of carrier 100 at lowest point of arcuate path when swinging back from highest point 4 | 28.0 m/s |
| Velocity of carrier 100 at release position 3 | 26.6 m/s |
| Time to accelerate from start position 1 to release position 3 | 2.25 s |
| Velocity of bogie 231 at release position 3 | 26.6 m/s |
| Acceleration of bogie 231 between start position 1 and release position 3 (assuming linear acceleration) | 11.8 $m/s^2$ |
| Energy required to accelerate carrier 100 from rest | 211,783 J |

The embodiments described herein provide configurations to elevate the swing carrier to the desired maximum swing height that are less time consuming than the prior art and do not require the construction or availability of an additional launch structure. It can be seen from the drawings and description that the embodiments described herein only require the carrier 100 to be moved back to a small height, while still enabling the carrier to be swung to a significant maximum swing height after release from the launch system. The launch arrangement is a high-speed arrangement whereby the swing carrier can be launched from at or near ground level at high velocity to rapidly attain the desired maximum swing height.

A further advantage of the embodiments described herein is that the launch mechanism is independent of the carrier and the elongate suspension members, making the ride inherently safe. If the launch mechanism failed, the rider(s) would remain safely suspended in the carrier. After the initial launch by the launch system, the launch system is disconnected from the carrier (due to the tether being decoupled), and does not influence the swinging motion of the carrier.

Preferred embodiments of the invention have been described by way of example only and modifications may be made thereto without departing from the scope of the invention.

Figure 8:
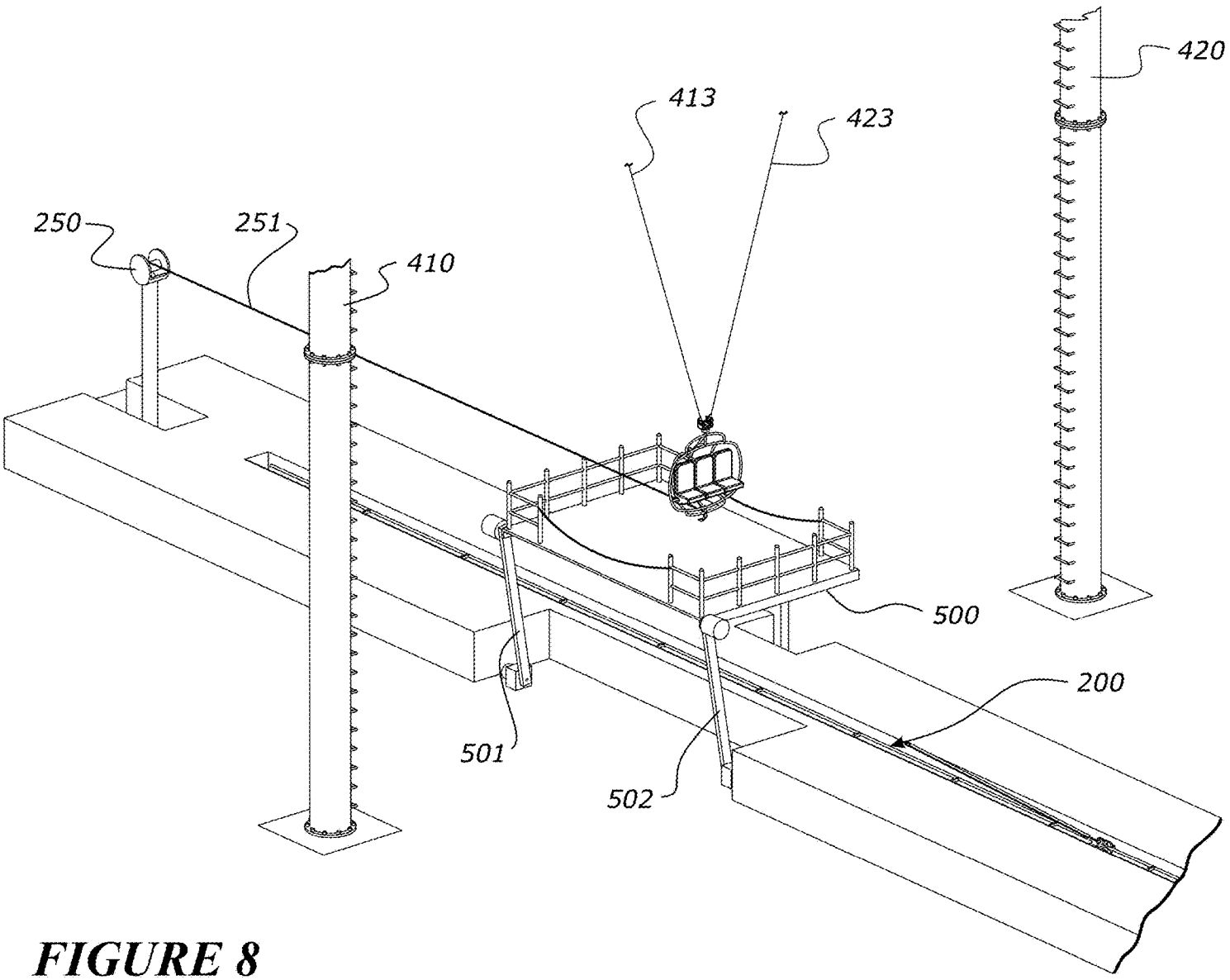
FIG. 8 is a perspective view of an exemplary loading platform of the ride, with the platform in a raised position.
Figure 9:
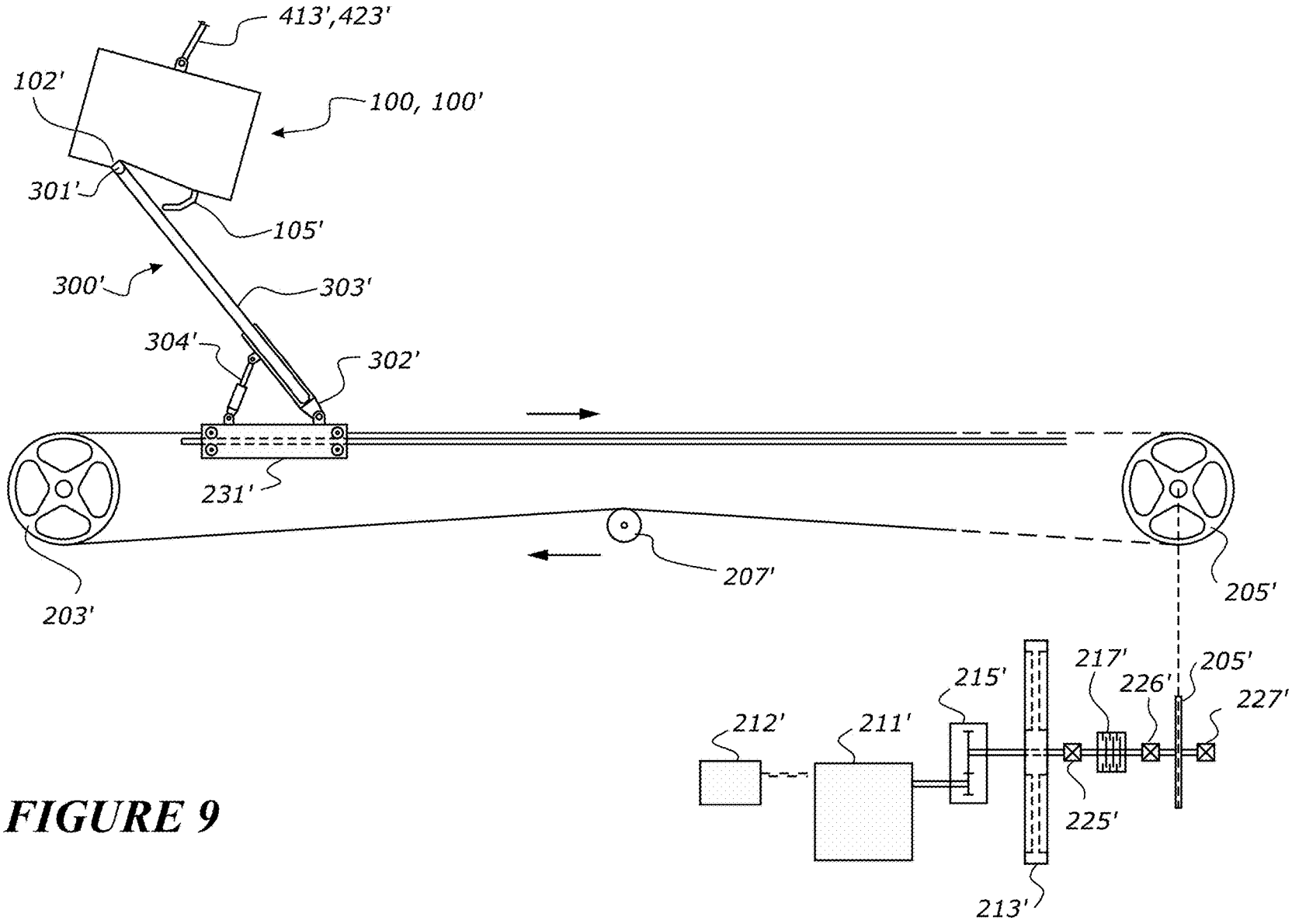
FIG. 9 is a side view of an alternative exemplary embodiment launch system when the carrier is in the push-back/start position, where broken lines represent discontinuation of the launch member which is not shown at full length.
Figure 10:
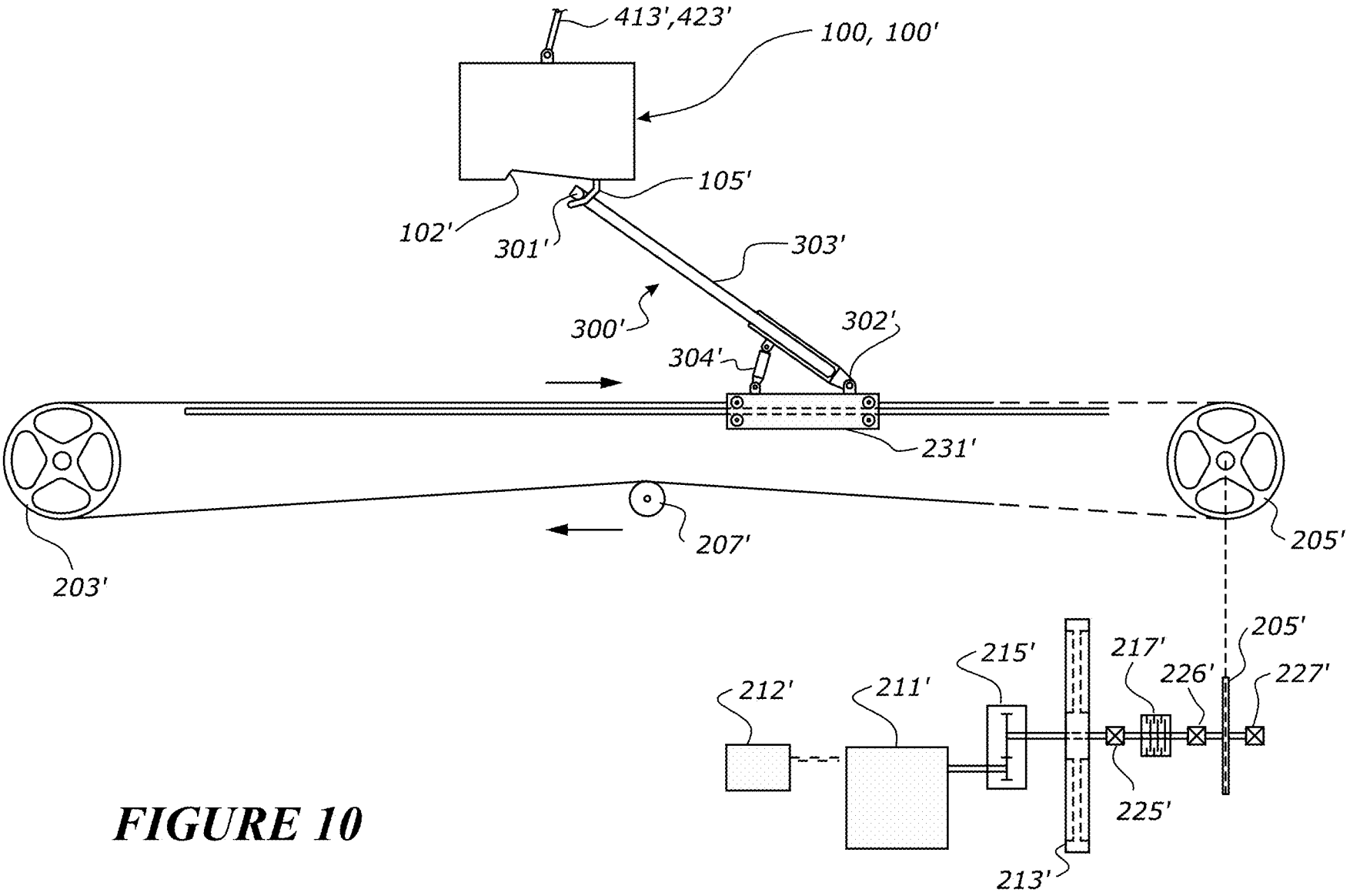
FIG. 10 is a view similar to FIG. 9 when the carrier is being accelerated, where broken lines represent discontinuation of the launch member which is not shown at full length.
Figure 11:
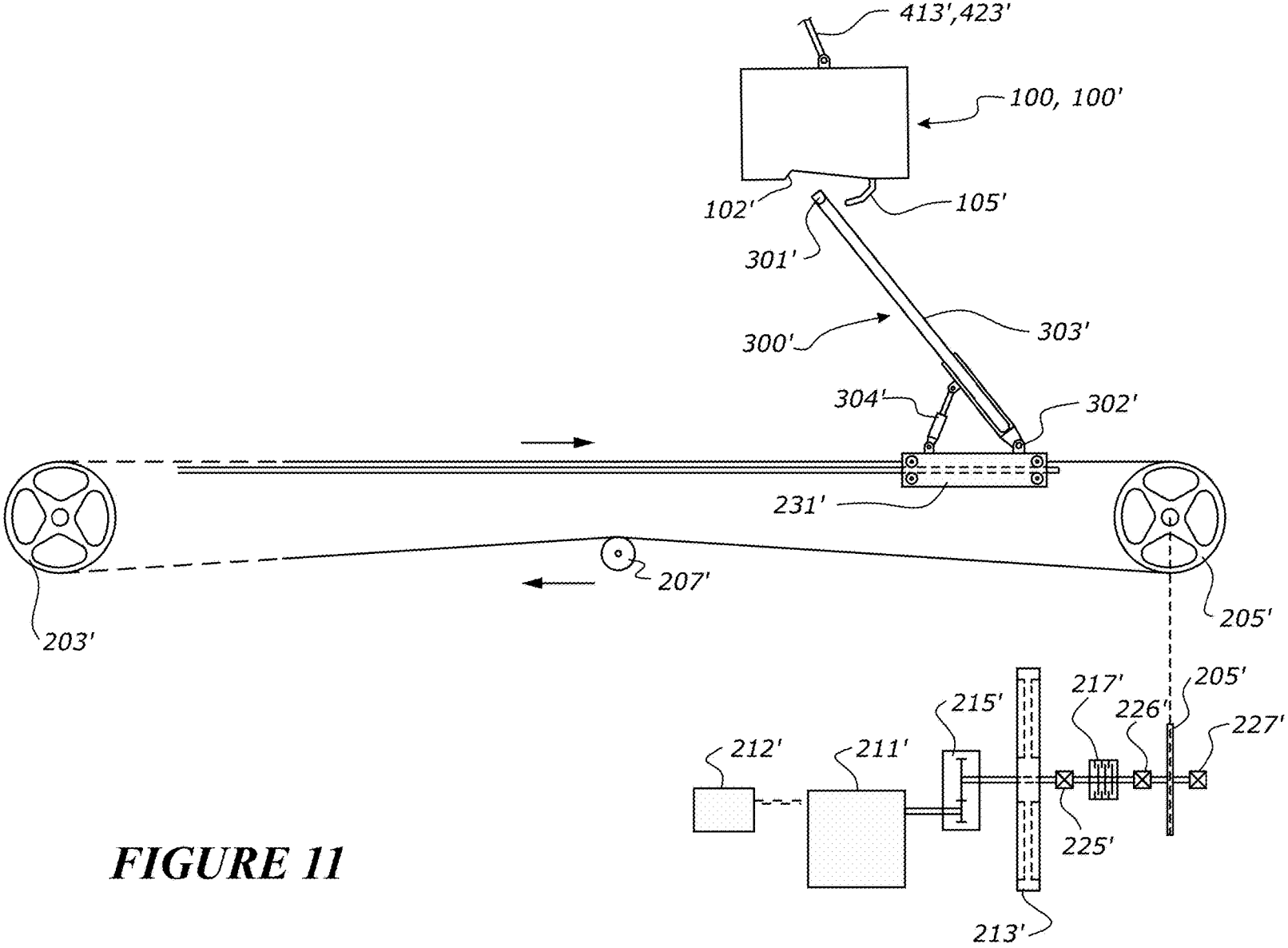
FIG. 11 is a view similar to FIGS. 8 and 9 when the carrier is being released from the launch system, where broken lines represent discontinuation of the launch member which is not shown at full length.

For example, in the embodiments described herein, the carrier 100 is initially moved in the second direction 160 to the pull-back/start position. Rather than using a pull-back winch, the launch system may be reversible to initially move the carrier rearwards in the second direction before launching the carrier in the first direction. FIGS. 9 to 11 show such a configuration including a push-back mechanism comprising the rigid tether 300' which can be used to both push the carrier 100, 100' rearwards in the second direction to a start position (FIG. 8) and to accelerate (FIG. 9) and launch (FIG. 10) the 100 carrier in the first direction. Unless described below, the features, functionality, and alternatives are the same as for the embodiments described above, and like reference numerals are used to indicate like parts, with the addition of a prime (′). It should be noted that in the push-back mechanism shown in FIGS. 9 to 11 could be used with either carrier 100 or carrier 100', and so both reference numbers are shown.

In this embodiment, a first end 301' of the rigid tether 300' is arranged to releasably couple to two parts of the carrier 100, 100'; a push-back engagement surface 102' (FIG. 9) and the tether hook 105'. The second end 302' of the tether 300' is articulated to the launch bogie 231'. A position actuator 304' is provided between the launch bogie 231' and the tether 300'. In the form shown, the position actuator comprises a ram. The position actuator 304' enables the tether 300' to move from a relatively large angle (relative to the launch bogie 231') in the pushback position of FIG. 9, to a relatively small angle in the lowest carrier position of FIG. 10, to a relatively large angle in the release position of FIG. 11. The position actuator 304' limits the maximum angle of the tether 300' relative to the launch bogie 231' so that the carrier 300' can detach from the tether 300' at the launch point. The position actuator may be biased toward its extended length, or may be controlled throughout the pushback and launch procedure.

In the form shown, the pushback engagement surface 102' on the carrier 100, 100' comprises a step or shoulder that engages with the first end 301' of the tether. The pushback engagement surface could be any other suitable form. The first end 301' of the tether may comprise a cross member that is engageable with the pushback engagement surface 102' and with the engagement hook 105'.

In this configuration, once the riders have entered the carrier 100, 100', the launch mechanism is driven rearwardly so that the first end 301' of the tether pushes the carrier back to the start position shown in FIG. 9. The launch mechanism is then driven forward rapidly so that the first end 301' of the tether slides along the underside of the carrier and engages the tether hook 105', to accelerate the carrier through the lowest swing position (FIG. 10) to be released at the release position (FIG. 11). The launch bogie 231' may remain at the position shown in FIG. 11, or further towards the pulley 205' until the carrier 100, 100' has stopped swinging.

In an alternative embodiment, the push back mechanism may comprise a push-back member that is separate from the tether 300' and independently driven, the push-back member arranged to push the carrier in the second direction along the arcuate path to the start position.

In an alternative configuration, the engagement position of the launch system may be at the lowest point of the arcuate path AP, and the carrier 100 may be launched from the position shown in FIG. 7 once the platform 500 is lowered, without initially pulling or pushing back the carrier to the start position. However, pulling or pushing the carrier back to the start position 1 is preferred, as that will enable the carrier to be swung to a greater maximum height, and may provide a smoother launch experience for the rider(s) if the carrier is initially released from the pull/push-back/start position before being engaged and launched by the launch system.

As another example, the carrier 100 is described as swinging back and forward along the arcuate path AP after the carrier 100 has been launched. In an alternative configuration, the carrier 100 may be steerable after the initial launch by the launch mechanism 200. For example, the carrier may be provided with a controllable rudder or similar steering device to enable the rider(s) to control the direction of swinging of the carrier after the initial launch by the launch system 200. The rudder may, for example, be a tail rudder, and may be controlled by a steering input device such as a rider-operable control stick or other controller. By changing direction of the carrier, the direction of the arcuate path AP relative to the ground will change, effectively forming a plurality of arcuate paths along which the carrier can swing back and forth. Such a configuration may be particularly suited to a carrier that is suspended from a cantilevered support structure or from elongate support member(s) that is/are suspended, such as across a natural feature such as a gully for example. Additionally, or alternatively, the carrier 100 may be provided with a rider-operable power source such as a propeller for example, to enable the rider to control the magnitude of swinging after the initial launch by the launch system 200.

The invention claimed is:

1. A launched swing amusement ride comprising:

a carrier for carrying a rider, wherein the carrier is suspended to swing from a support by at least one elongate suspension member and is arranged to swing in more than one direction along an arcuate path, the arcuate path having a lowest point;

a launch mechanism having a driven element located outside of the arcuate path; and a tether configured to:

releasably couple the carrier to the driven element, the driven element accelerating the carrier in a first forward direction through a portion of the arcuate path between an engagement position and a release position, and then decouple the carrier from the driven element at the release position to propel the carrier in the first forward direction on the arcuate path on an upward trajectory relative to the release position.

2. The amusement ride according to claim 1, wherein the tether is releasably coupled to the carrier.

3. The amusement ride according to claim 2, wherein at least one of:

the tether is connected to a tether arresting member arranged to restrict the movement of the tether following its release from the carrier, or a tether retraction device is operatively connected to the launch mechanism and is arranged to retract the tether when it is released from the carrier.

4. The amusement ride according to claim 1, further comprising a pull-back winch that is releasably coupled to the carrier.

5. The amusement ride according to claim 4, wherein the pull-back winch is arranged to pull the carrier in a second direction along the arcuate path to a start position that is higher than the lowest point of the arcuate path.

6. The amusement ride according to claim 1, further comprising a push-back mechanism that is releasably coupled to the carrier, wherein the push-back mechanism is arranged to push the carrier in a second direction along the arcuate path to a start position that is higher than the lowest point of the arcuate path.

7. The amusement ride according to claim 1, wherein the launch mechanism is arranged to begin accelerating the carrier when the carrier is positioned at the engagement position along the arcuate path.

8. The amusement ride according to claim 1, wherein the carrier is arranged to reach a maximum height when the direction of travel of the carrier changes from the first forward direction to a second direction, after being launched from the launch mechanism.

9. The amusement ride according to claim 1, wherein the elongate suspension member comprises a cable or a plurality of cables.

10. The amusement ride according to claim 1, wherein the carrier is suspended from a single support tower.

11. The amusement ride according to claim 1, wherein the carrier is suspended between two adjacent support towers, one on either lateral side of the arcuate path and the carrier.

12. The amusement ride according to claim 1, wherein the support comprises one or more elongate support members, wherein the elongate suspension member(s) hang from the elongate support member(s).

13. The amusement ride according to claim 1, wherein the carrier is arranged to support one rider, or wherein the carrier is arranged to support a plurality of riders.

14. The amusement ride according to claim 13, wherein the carrier comprises one or more rider support(s), and wherein the rider support(s) is/are configured to rotate relative to the elongate suspension member(s) at or near an end of each swing arc so that rider(s) supported by the rider support(s) face forward throughout at least a major part of each swing arc.

15. The amusement ride according to claim 1, wherein the carrier is steerable after the initial launch by the launch mechanism.

16. The amusement ride according to claim 1, wherein the carrier is provided with a rider-operable power source, to enable the rider to control the magnitude of swinging after the initial launch by the launch system.

17. The amusement ride according to claim 1, wherein the driven element is a launch bogie.

18. A launched swing amusement ride comprising:

a carrier for carrying a rider, wherein the carrier is suspended to swing from a support by at least one elongate suspension member and is arranged to swing in more than one direction along an arcuate path, the arcuate path having a lowest point;

a launch mechanism located outside of the arcuate path; and a tether configured to:

releasably couple the carrier to the launch mechanism to accelerate the carrier in a first direction through a portion of the arcuate path between an engagement position and a release position, and decouple the carrier from the launch system at the release position to propel the carrier on an upward trajectory on the arcuate path, wherein:

the launch mechanism comprises a driven, elongate member extending between pulleys, and the elongate member is releasably coupled to the carrier by the tether and is positioned at least one of beneath or to a side of the arcuate path.

19. The amusement ride according to claim 18, further comprising an energy source that is operatively connected to the elongate member to drive the elongate member.

20. The amusement ride according to claim 19, wherein:

the launch mechanism comprises a flywheel adapted to store energy, the energy source to rotate the flywheel, and a first selective energy transfer mechanism operatively connected to the flywheel, and the first selective energy transfer mechanism is operable to transfer energy from the flywheel to the elongate member to accelerate the carrier along the portion of the arcuate path.

21. The amusement ride according to claim 20, wherein activation of the first selective energy transfer mechanism results in rotation of at least one of the pulleys, to accelerate the carrier along the portion of the arcuate path.

22. The amusement ride according to claim 20, wherein the first selective energy transfer mechanism comprises a mechanical clutch, an epicyclic gearbox, or a hydraulic motor.

23. A launched swing amusement ride comprising:

a carrier for carrying a rider, wherein the carrier is suspended to swing from a support by at least one elongate suspension member and is arranged to swing in more than one direction along an arcuate path, the arcuate path having a lowest point;

a launch mechanism located outside of the arcuate path; and a tether configured to:

releasably couple the carrier to the launch mechanism to accelerate the carrier in a first direction through a portion of the arcuate path between an engagement position and a release position, and decouple the carrier from the launch system at the release position to propel the carrier on an upward trajectory on the arcuate path, wherein the launch mechanism is located substantially at ground level.

* * * * *